United States Patent [19]

Kawarabashi et al.

[11] Patent Number: 4,541,578

[45] Date of Patent: Sep. 17, 1985

[54] DOFFING APPARATUS IN AUTOMATIC WINDER

[75] Inventors: Tsukasa Kawarabashi, Kyoto; Shinji Takahashi, Joyo, both of Japan

[73] Assignee: Murata Kikai Kabushiki Kaisha, Kyoto, Japan

[21] Appl. No.: 521,383

[22] Filed: Aug. 8, 1983

[30] Foreign Application Priority Data

Aug. 11, 1982 [JP] Japan ..... 57-140448
Jul. 19, 1983 [JP] Japan ..... 58-131526

[51] Int. Cl.[4] ..... B65H 54/20; B65H 67/06
[52] U.S. Cl. ..... 242/35.5 A
[58] Field of Search ..... 242/35.5 A, 35.5 R, 242/18 R, 18 A, 35.6 R

[56] References Cited

U.S. PATENT DOCUMENTS 3,160,359 12/1964 Furst ..... 242/35.5 R

*Primary Examiner*—Stanley N. Gilreath
*Attorney, Agent, or Firm*—Spensley Horn Jubas & Lubitz

[57] ABSTRACT

A doffing apparatus in an automatic winder having a plurality of winding units. A transporting conveyor for conveying doffed full packages is provided to extend along the units and package guide path is provided between the transporting conveyor and a position wherein full packages are discharged from the winding unit. A stock device for temporarily stopping the full packages is provided on the guide passage.

6 Claims, 13 Drawing Figures

DOFFING APPARATUS IN AUTOMATIC WINDER

BACKGROUND OF THE INVENTION

The present applicant has previously proposed an apparatus, in an automatic winder having a number of winding units juxtaposed thereon, wherein full packages wound to a preset amount or to a preset length are automatically doffed to transfer said packages onto a conveyor which extends at the rear of the units along each of said units. That is, Japanese Patent Application Laid-Open No. 56-132269 discloses an apparatus wherein full packages disengaged from a cradle arm are placed on a belt conveyor provided at the rear of units for storage or conveyance.

In such an apparatus, doffing is not always possible to be achieved even if a full package signal is issued to the unit in which full packages are stored on the conveyor. That is, if a new full package were to be doffed despite full packages are already placed on the belt conveyor, the new full package would be impeded by the package already placed on the conveyor, which would to hamper the succeeding winding. In a case where the conveyor is driven to automatically convey full packages, when packages are doffed at a certain winding unit during the circle of the conveyor that is, during the conveyance of full packages, the doffed full packages likewise may impinge upon packages being conveyed, and even if they are transferred by chance onto the conveyor, the attitude of packages may be disordered to hamper the succeeding steps.

Even if the doffing operation should be stopped during the conveyance of the full packages, it would take considerable time until, upon revolution of the lengthy conveyor disposed along a number of units, all the packages on the conveyor are discharged out of the automatic winder. Therefore, stopping of the doffing operation during a period of time as just mentioned is extremely inconvenient in view of the working efficiency of the winder.

Morover, where different kinds of cops are shared by separate winding units, that is, the winder is divided into some groups of units to rewind the different kinds of cops by a single winder, the following inconveniences are encountered.

That is, in the aforesaid apparatus, when wound packages are doffed, they are automatically and successively conveyed by a belt conveyor, and therefore, full packages from each of the units, which have been wound at different time depending on different times of yarn breakage, are delivered at random towards the outlet of the conveyor, and as the result, the full packages of different kinds of yarns are mixed at the outlet, which requires extra sorting work by hand. Particularly, in case of yarns analogous to one another, sorting is extremely difficult.

The aforementioned inconveniences can not be overcome due to the fact that even if timing such as winding start time is made inconsistent for every group of a plurality of units for winding cops of different kind while being shared, winding time for every unit differs with the aforesaid times of yarn breakage, and therefore, the winding time in each unit is at any rate completely random.

SUMMARY OF THE INVENTION

The present invention relates to a doffing apparatus in an automatic winder.

An object of the present invention is to provide an apparatus in which full packages discharged from winding units are temporarily stored and then they are transferred on to conveyors.

In an apparatus of the present invention, a package guide path is provided between a transporting conveyor which extends along a number of winding units of an automatic winder and a position wherein full packages are disengaged from a cradle portion of each winding unit, and a stocking device for temporarily stopping the full packages doffed onto the guide path is provided halfway along the guide path.

Further, even when different kinds of cops are wound by a single winder, the full packages are completely sorted for every cop of different kind and delivered outside the automatic winder respectively.

According to the present invention, a guide path for packages is provided between conveyor which extends along each of units of an automatic winder having a number of winding units juxtaposed one another, the converyor being provided to move full packages placed thereon, and a position wherein the full packages are disengaged from a cradle portion of each of the winding units. A stocking member for temporarily stopping the full packages is arranged to be halfway along each guide path. Therefore, the full packages doffed from the cradle portion are once stocked at the position of the stocking member. They are then discharged onto the conveyor as a group at a given time. Therefore, the packages are not discharged at random and directly onto the conveyor from the individual units. Thus, the packages do not impinge upon the packages already placed on the conveyor and the automatic doffing apparatus need not be stopped during the rotation of the conveyor to increase the working efficiency of the doffing apparatus and increase the winding efficiency of the winder. This is particularly effective for the automatic winder having an automatic doffing apparatus. Moreover, the full packages are not directly rolled on to the conveyor from the cradle portion but are once stopped in the midst of the guide path, after which the packages are then rolled on the conveyor along the remaining guide path. Therefore, the attitude of the packages can be controlled, and the impingement of the surface of the yarn layer which occurs when packages are transferred onto the conveyor can be also relieved to prevent said surface from being damaged or deformed.

Furthermore, if said stocking bar is cut for each of the plurality of units and a driving source for individually actuating the stocking bars, packages can be discharged onto the conveyer under the condition wherein different kinds of packages different in count, color, etc. are not mixed.

That is, in a winder which is designed so that a single automatic winder is divided into sections for each of the plurality of units to wind yarns of different kinds in each section, said stocking bars are independently provided for every section and are actuated so that packages of the same kind can be discharged as a group and can be conveyed under the condition wherein different kinds of packages are not mixed.

DETAILED DESCRIPTION OF THE INVENTION

The preferred embodiment of the present invention will now be described in connection with the drawings.

Figure 1:
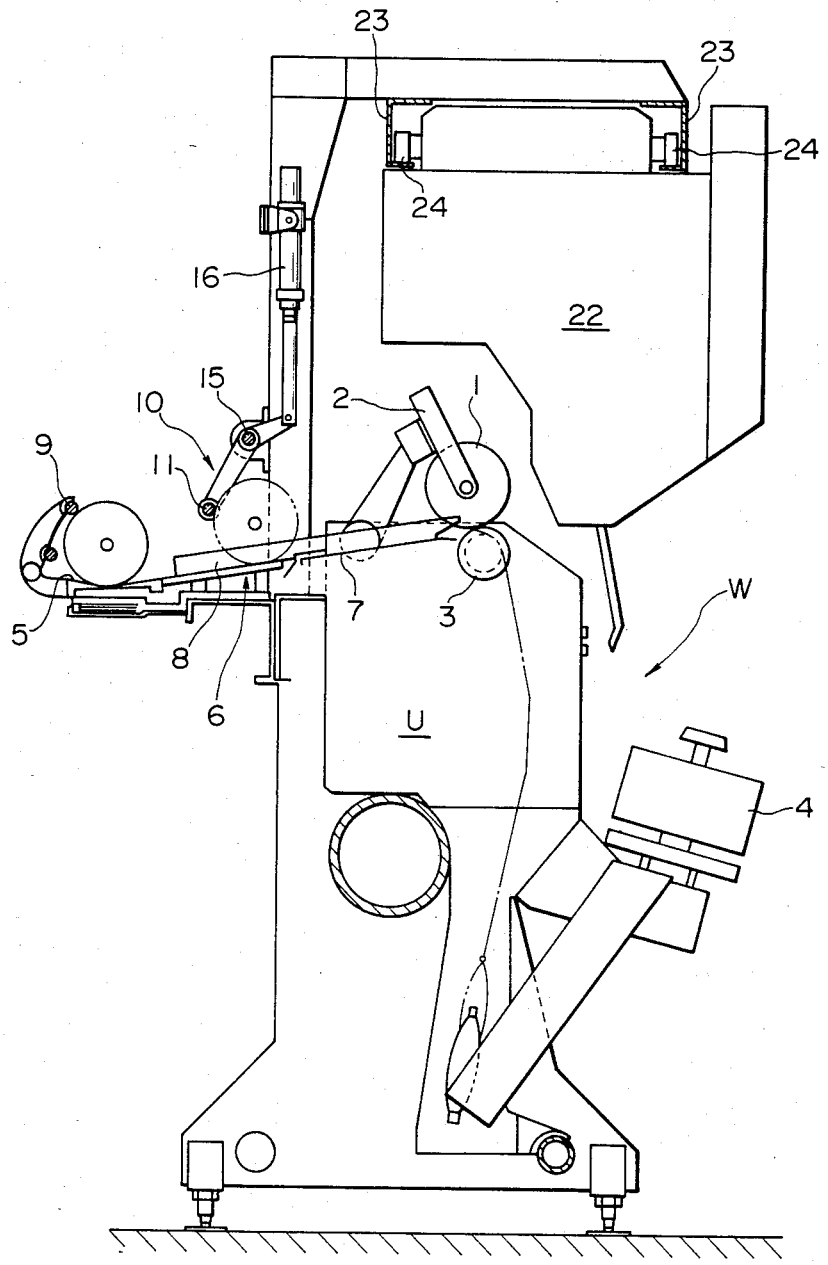
FIG. 1 is a side view showing a schematic structure of a winder having apparatus in accordance with the present invention.

In FIG. 1, there is shown an automatic winder indicated as at W which has a number of winding units U juxtaposed at right angles to the surface of paper, each of said units U comprising a cradle portion 2 for supporting a winding package 1, a transverse drum 3 which comes into contact with the package to rotate the latter while traversing yarns, and a magazine 4 for storing a plurality of cops and the like, winding being effected in a well known manner.

At the rear of the aforesaid unit, that is at the rear assuming that the side of a yarn travelling path is a front portion, there is disposed a full package transporting conveyor belt 5 which extends along the units, and in a position of each unit on the conveyor there is provided a guide passage 6, which is formed by a bottom plate 7 and a side plate 8, for guiding full packages, which are disengaged from the cradle portion 2, from the disengaged position to the conveyor. The guide passage 6 is slightly inclined towards the conveyor 5 and has an angle $\theta$ of inclination enough to permit the full package disengaged from the cradle portion 2 to be rolled by its own weight.

A guide bar 9 secured along the side of the conveyor belt 5 extends over the whole unit winder and serves as a stopper and attitude controller for packages which roll on the guide passage 6 and are placed on the conveyor belt 5. A package impinges upon the guide bar 9 and then rebounds whereby the axis of the package is placed parallel to the travelling direction of the conveyor. The guide bar 9 is fixed in a position where the former is not in contact with the outer surface of a yarn layer of the package during the conveyance of packages.

Further, midway along the guide passage 6 there is provided a stocking device 10 which temporarily stops a package disengaged from the cradle portion.

Figure 2:
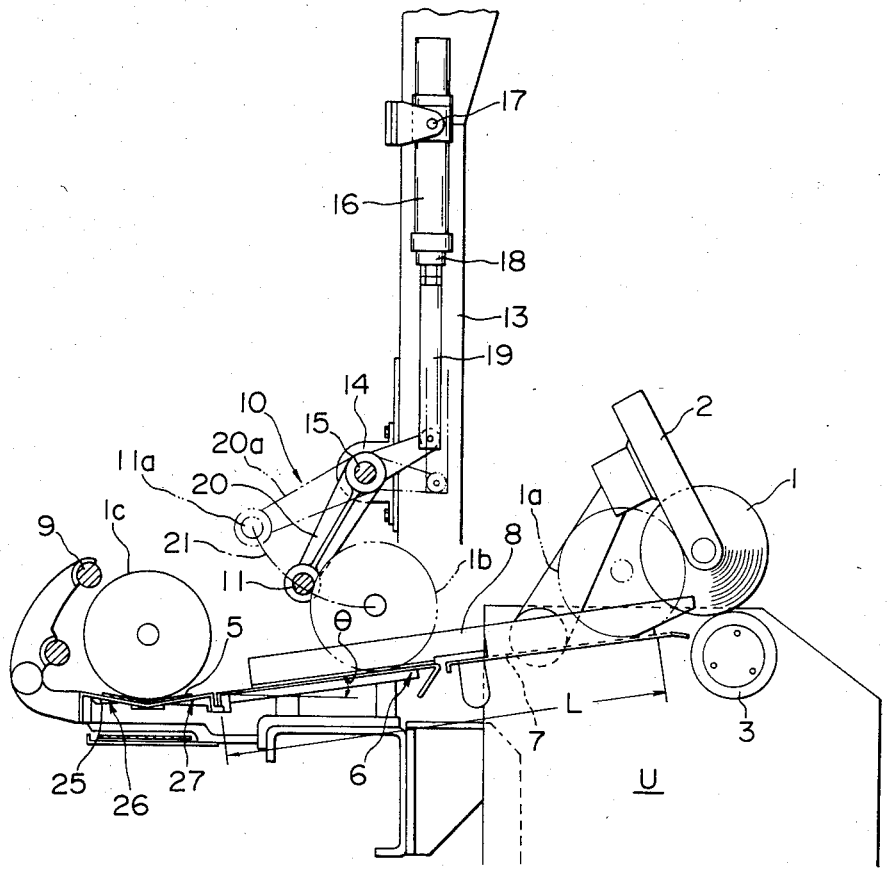
FIG. 2 is a side view showing an embodiment of a doffing apparatus in accordance with the present invention.
Figure 3:
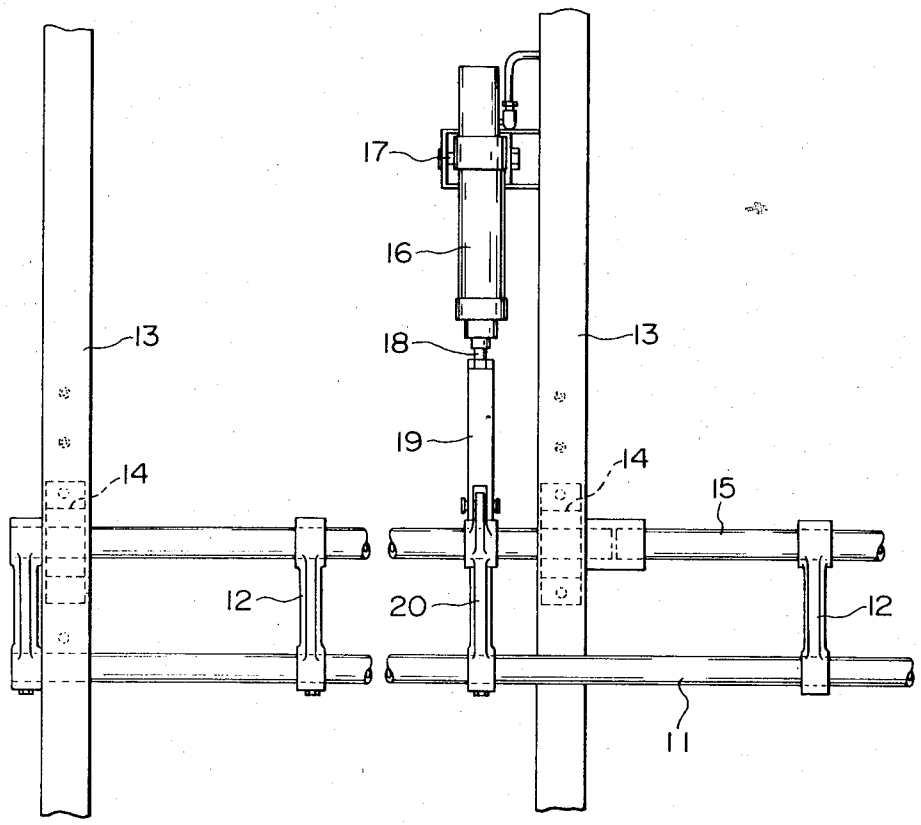
FIG. 3 is a rear view showing a part of the same.

The stocking device 10 shown in FIGS. 1 to 3 is composed of a stocking bar 11 extending over the whole winder, a supporting bar 15 which supports said stocking bar 11 through a plurality of brackets 12 in a suitably spaced relation. The supporting bar 15 is supported by bearings 14 secured to a machine frame 13. A fluid cylinder 16 for swivelling the stocking bar is provided in the neighbourhood of opposite ends in a longitudinal direction of the winder. That is, in FIGS. 2 and 3, a lever 20 pivotable about the supporting bar 15 is pivotally mounted on the supporting bar 15 at the lower end of a connection rod 19 connected to a piston rod 18 of the fluid cylinder 16 supported at 17 on the machine frame 13, and the stocking bar 11 is connected to the extreme end of the lever 20. With this arrangement, upon actuation of the fluid cylinder 16, the stocking bar 11 is swivelled between the position indicated by the solid line and the position indicated by dash-dotted contour lines 11*a* in FIG. 2 and can be located in both said positions.

The stocking bar 11 is provided in a position wherein a circular locus 21 of the center of the stocking bar 11 passes through the center of a package 1*b* which is stopped by the stock bar 11.

That is, the height or level of the bearing 14 to be mounted on the machine frame 13 is adjusted in accordance with the size of the full package 1*b*, and the connection rod 19 connected to the piston rod 18 is replaced with a rod which is different in length therefrom to thereby adjust the position of the stocking bar 11.

That is, if the position wherein the stocking bar 11 abuts against the package 1*b* is excessively low, the length of the lever 20 is great and the radius of swivel increases accordingly, because of which it likely impinges upon the package on the conveyor 5. To avoid this, the guide passage 6 would have to be lengthened, which is impractical in terms of space.

On the other hand, if the position wherein the stocking bar 11 abuts against the package 1*b* is excessively high, it assumes a state that the package creeps under the stocking bar, and the surface of a yarn layer of the package is likely to be damaged. It is therefore advantageous to employ the above described position for the position wherein the stocking bar 11 abuts against the center of the package.

The length L of the guide path 6 advantageously comprises the length which includes the distance which does not interfere with the packages 1*a* and 1*c* in said both positions between the position 1*a* of the full package disengaged from the cradle portion 2 and the conveyor 5, which enables at least one full package to be located between both the packages 1*a* and 1*c*, and which is free from interference of the stocking bar 11 with the package 1*c* on the coneyor 5 when the stocking bar 11 is swivelled.

It is noted that doffing of each of said units is carried out by a travelling member 22 shown in FIG. 1. That is, the travelling member 22 is suspended, through wheels 24 and 24, from ceiling rails 23 and 23 laid above and along the units, whereby the full package 1 is disengaged from the cradle portion 2 by means of a doffing mechanism (not shown) provided on the travelling member 22, and empty bobbins received within the travelling member 22 are supplied to the cradle portion 2 for accomplishment of re-winding.

Next, the operation of the apparatus in accordance with the present invention will be described.

Figure 4:
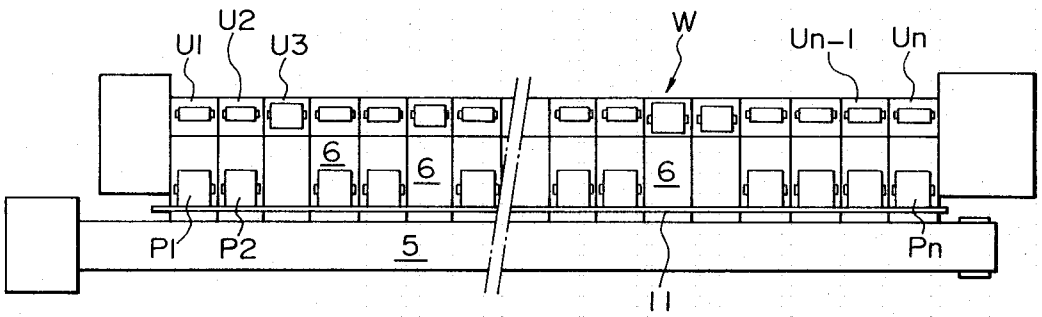
FIGS. 4 to 6 are respectively schematic views showing the function of said apparatus.
Figure 5:
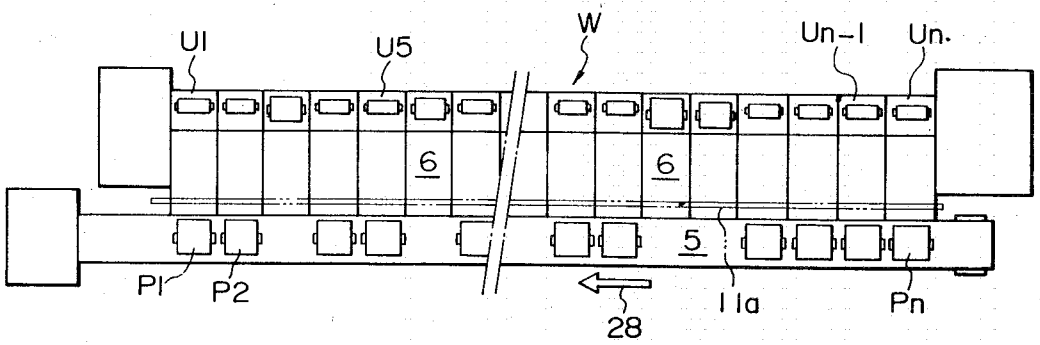
Figure 6:
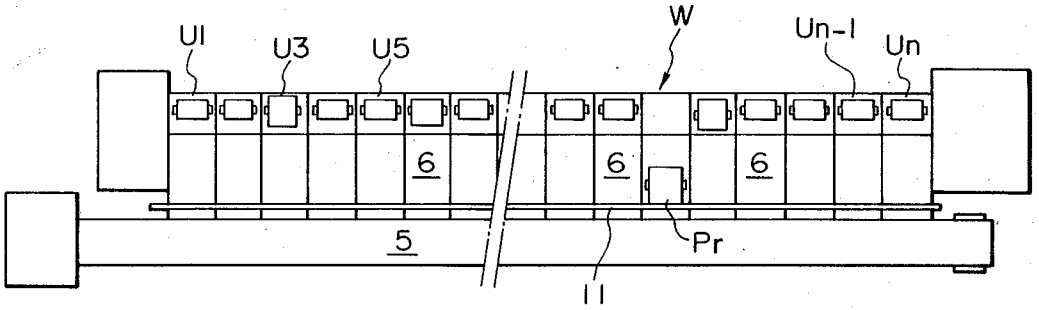

Referring to FIGS. 4 to 6, winding is carried out at each of winding units U1 to Un. When a given amount of yarn layers is formed, a full package is disengaged from the cradle portion by the aforementioned doffing operation, and said package falls onto the guide passage 6 and is rolled by its own weight through the inclination of the guide passage 6, said package being rolled to the position of the stocking bar 11 until it stops at said position.

FIG. 4 is a plan view showing the state of packages stocked after a lapse of given time from the beginning of winding. Packages P1–Pn are once stocked on the guide passage 6 by means of the stocking bar 11.

In each winding unit, there is a difference in time to form a full package due to various causes such as yarn breakage, number of times of knotting and the like, resulting in a difference in doffing time, which leads to the state shown in FIG. 4.

Assuming now that for example, the time T required to form a full package is 60 minutes on average, the time interval t of opening the stocking bar is set to the relation represented by $t<T$ (for example, $t=50$ minutes), and setting is made by use of a timer so that the fluid cylinder 16 of FIG. 2 may be actuated every 50 minutes.

FIG. 5 shows the state wherein all the packages P1 to Pn stocked as shown in FIG. 4 are discharged onto the transporting conveyor 5 by the opening of the stocking bar 11. The fluid cylinder 16 shown in FIG. 2 is actuated and the stocking bar 11 is swivelled to the dash-dotted contour line position 11*a*, whereby the packages P1 to Pn being stocked are further rolled on the inclined guide passage 6, discharged onto the conveyor 5, impinge upon guide bar 9, rebound and are placed on the conveyor 5 so that the axis of the packages is made parallel to the travelling direction of the conveyor 5.

A guide plate 25 which supports the conveyor 5 is formed with inclined surfaces 26 and 27 directed from both side edges to the center thereof to locate the packages to the center of the conveyor. According, the doffed packages are not immediately rolled from their position disengaged from the cradle portion onto the conveyor but are stopped and stocked once by the stocking bar 11 in the intermediate position, and therefore, the packages are prevented from impingement upon the guide bar 9. Also, if packages are of cones which are easily moved in a zigzag fashion as compared with cheeses as shown, it is possible to control the attitude of the cone packages by the stocking bar 11 to smoothly discharge them along the guide passage 6.

During the travelling of the conveyor 5, the stocking bar 11 is again returned to its original position (as indicated by the solid line of FIG. 2) as shown in FIG. 6 to stock packages Pr doffed during the conveyance of packages.

Figure 7:
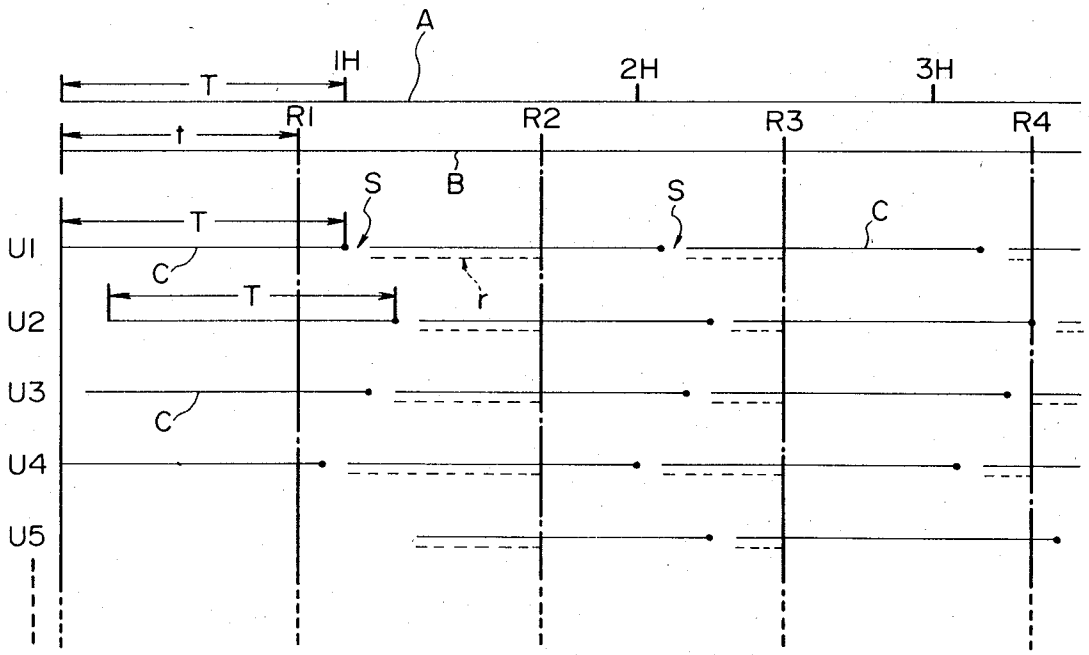
FIG. 7 is a time chart diagram of the same.

A time chart of the aforesaid operation is shown in FIG. 7. Winding time A and opening time B for the stocking bar 11 are indicated on the axis of abscissa, and solid lines c in the winding units U1 to U5 indicate time required for winding. Doffing operations are carried out in spaces S between the solid lines. The time during which doffed full packages are stocked on the guide passages 6 is indicated as at the broken line r.

For example, in the winding unit U1, after a lapse of time T from the beginning of winding, a full package is obtained, a doffing operation is carried out during the time S after a full package signal has been issued, and winding is again started.

The doffed package is stocked during the time r by the stocking bar 11 on the guide path, and at the opening time R2 of the stocking bar, the stock package is released and discharged onto the conveyor.

The same is true for other units. However, the units are different in doffing time from one another, and therefore, the time r during which full packages are stocked on the guide passage differs with each unit and with doffing time and stocking-bar opening time even in each unit. However, in one and the same unit, it does not occur that more than two full packages are stocked on the guide passage. This is because of the fact that more than two times of doffing is not effected within the time t because the opening time t of the stocking bar 11 is smaller than the time T required to form a full package.

Accordingly, assuming that a single automatic winder W comprises, for example, 60 units, the time T for a full package is 60 minutes and the opening time t for the stocking bar 11 is 50 minutes, the stocking bar 11 is opened every 50 minutes and 50 to 60 pieces of full packages are discharged onto the conveyor 5 for conveyance.

While in the above-described embodiment, a stocking member comprises the stocking bar which extends through all the units, it can be designed to that for example, slits are suitably formed in a surface of a guide passage, and plates which are moved in and out of the surface of the guide passage through the slits are provided along all the units whereby the apparatus can be operated by means of a driving source such as a fluid cylinder or the like in a manner similar to that of the above-described embodiment.

Another embodiment in which different kinds of cops are rewound using a single automatic winder will be described hereinafter.

As a method for winding, for example, two kinds of different cops by an automatic winder W having 60 spindles, the following methods will be described: a method for manually inserting different cops into the magazine for every unit (for example, a cop A is inserted in the 1st to 40th spindle and a cop B is inserted in the 41st to 60th spindle); a method for automatically supplying the cops to the 1st to 40th spindle by using a travelling-truck type cop delivery device as disclosed in Japanese Patent Application Laid-Open No. 54-27037 filed by the present applicant, and for manually supplying the cops to the remaining the 41st to 60th spindle; and a method for completely automatically supplying the cops.

Figure 8:
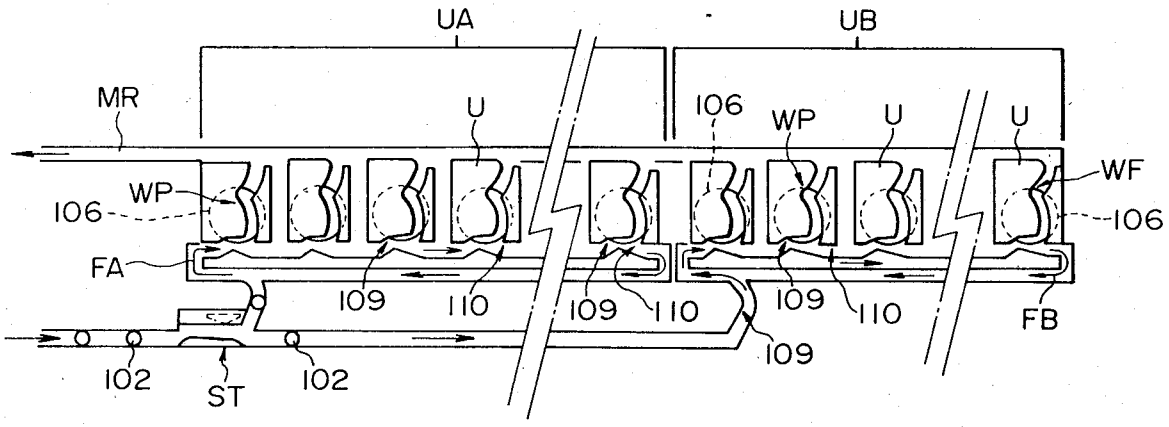
FIG. 8 is a plan view as a whole for explanation of the method of automatically supplying cops of different kinds to the automatic winder.

That is, as shown by a schematic plan view of a bottom portion of the automatic winder W in FIG. 8, a cop delivery passage FA, wherein only the cop A is circulated through a cop sorting-conveying device ST from a source of cop supply (not shown) and a cop delivery passage FG, wherein only the cop B is likewise circulated through the cop sorting-conveying device ST are formed along the winding units U, for example, by a belt conveyor 101 and a guide plate. A return passage MR for conveying empty bobbins which have been already wound is likewise formed, along the other side of the winding units U, by the belt conveyor 101 and the guide plate. In the unit group UA (e.g. 1st to 40th spindle), wherein said cop delivery passage FA is circulated, the cop A is wound, and in the unit group UB (e.g., 41st to 60th spindle), wherein the pirn delivery path FB is circulated, the cop B is wound.

Figure 9:
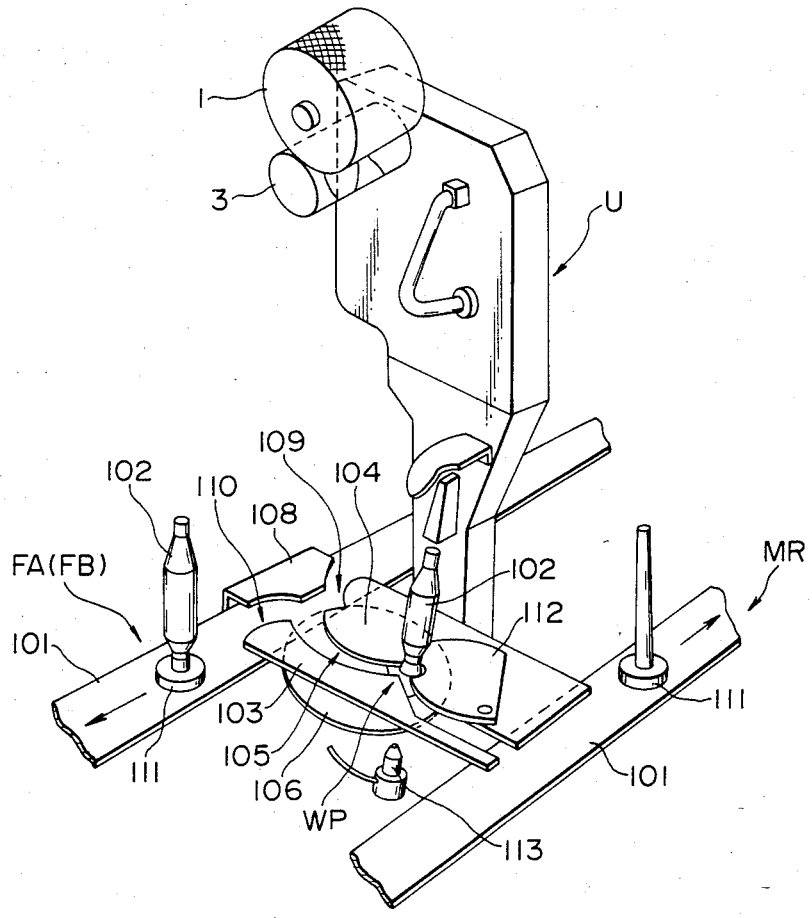
FIG. 9 is a perspective view of the winding units likewise showing the method of supplying the cops of different kinds.
Figure 10:
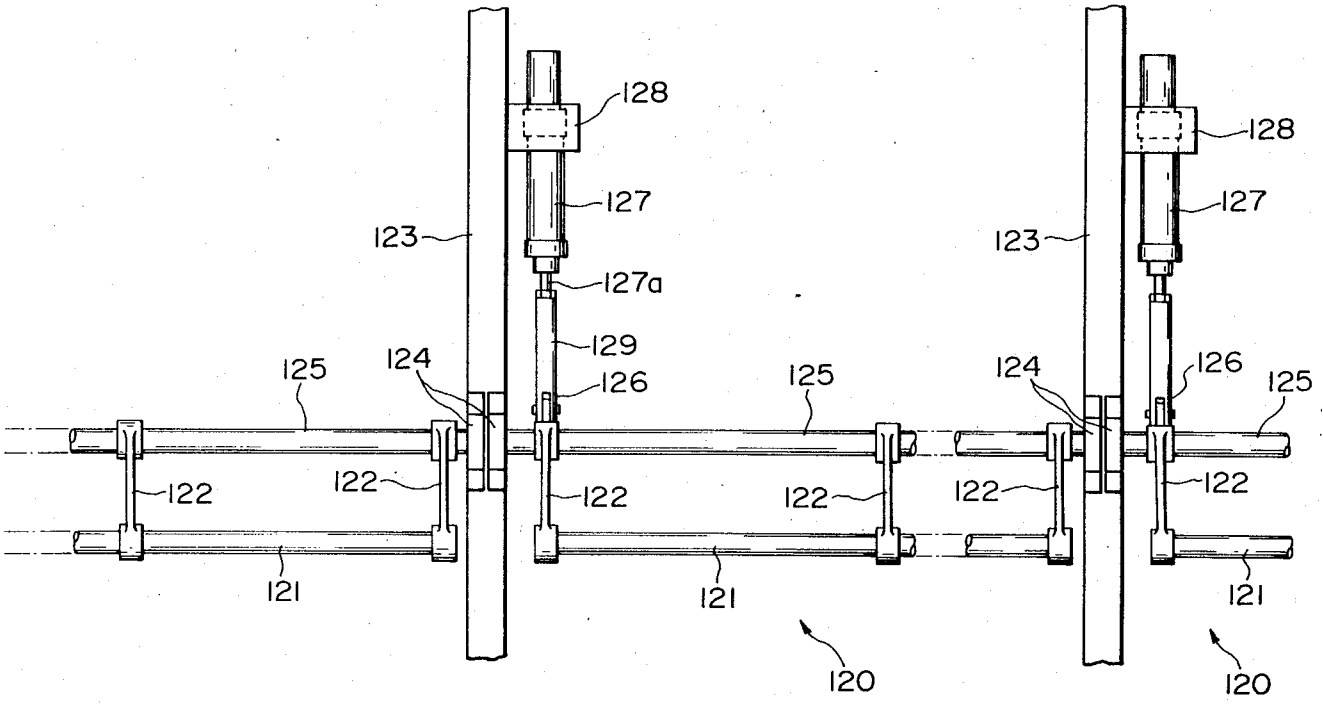
FIG. 10 is a partial rear view showing another embodiment of a doffing system of the present invention.

Cops 102 from the cop delivery passages FA and FB are taken into the units by an arrangement wherein, as schematically shown in a perspective view of FIG. 9, a passage 105, which passes directly below each winding unit, and which is formed by guide plates 103 and 104, is provided for each unit between the delivery passages FA and FB and the return passage MR. A rotary disk 106 is provided under the passage 105, and a cop inlet 109 and a surplus cop delivery outlet 110 are formed in the inlet of the passage 105 by a guide plate 108, whereby the cop 102 inserted into and stood up on a peg tray 111, which travels on the delivery passages FA and FB by rotation of the rotary disk 106, is introduced into a winding position WP directly under the unit. A reference numeral 112 designates an empty bobbin ejecting swivel lever which also serves as a locator for positioning the cop 102 introduced into the winding position WP, and 113 is a nozzle for jetting compressed air to blow up a thread which has been pre-hung into the wooden bobbin. The aforesaid cop sorting and conveying device ST comprises a cam means in which a disk portion of the peg tray 111 is formed with peripheral grooves differing in height by the type of cop carried thereon. The cam engages the peripheral grooves to distribute the destination of the peg tray; iron rings differing in height by the type of cop mounted on the disk portion of the peg tray 111, are sensed by a sensor for detecting said iron ring. A switch or point means is swung in response to a detection signal of said sensor to distribute the destination of the peg tray, and the like.

In accordance with the aforementioned third method, it is possible to automatically supply more than two kinds of cops to a single automatic winder, and if the cop delivery passages FA and FB are further divided to increase the number of passages, then more than three kinds of different cops can be automatically supplied.

While the method has been described in which in one automatic winder W, a number of units are divided into moe than two unit groups UA and UB so that more than two kinds of different cops are wound simultaneously by one and the same winder, it should be noted that any of said methods can be employed, which does not comprise a significant matter of the present invention.

In the following, the present invention will be described by way of an example where in the winder having 60 spindles shown in FIG. 1, the 1st to 40th spindle are for the unit group UA for winding the cop A and the 41st to 60th spindle are for the unit group UB for winding the cop B.

The stocking device 120 shown in FIGS. 4 to 10 is composed of a stocking bars 121 extending along each group of units which include 10 spindles respectively, a supporting bar 125 which supports said stocking bar 121 through brackets 122 in a suitably spaced relation. The supporting bar 125 is supported by bearings 124 secured to a machine frame 123. Fluid cylinders 127 for swivelling the stock bars are provided in the neighbourhood of opposite ends of the stocking bar in a longitudinal direction of the winder.

Figure 11:
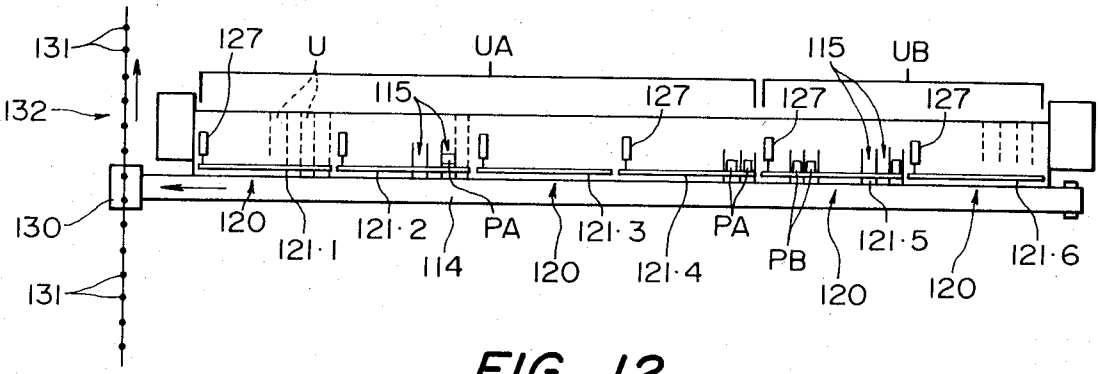
FIG. 11 is a schematic plan view as as whole of the same.

In this embodiment, 6 sets of the stocking device having same structures are in line as shown in FIG. 11 because there are 60 winding units and 60 spindles in the winder. One of the sets of the stocking devices will be illustrated in detail.

A lever 126 pivotable about the supporting bar 125 is pivotally mounted on the supporting bar 125 at the lower end of a connection rod 129 connected to a piston rod 127*a* of the fluid cylinder 127 supported at 128 on the machine frame 123, and the stocking bar 121 is connected to the extreme end of the lever 126. With this arrangement, upon actuation of the fluid cylinder 127, the stocking bar 121 is swivelled between the position indicated by the solid line and the position indicated by dash-dotted contour lines in FIG. 2 and can be located in both said positions.

The stocking bar 121 is provided in a position wherein a circular locus 21 of the center of the stocking bar 121 passes through the center of a package 1 which is stopped by the stocking bar 121.

The operation of this embodiment will be described.

Winding is carried out at each group of winding units UA, UB. When a given amount of yarn layers is formed, a full package is discharged from the cradle portion by the aforementioned doffing operation and the package falls onto the guide passage 6 and is rolled by its own weight on the inclined guide passage 6 to the position of the stocking bar 11 until it stops at the position.

That is, in each winding unit, time to form a full package differs with times of yarn breakage, as previously mentioned, and even if winding starts at the same time, doffing time differs for every unit. However, all the packages P doffed at said different time are stopped by the stocking bar 121 irrespective of the units U and the kind of yarns. Accordingly, after a lapse of given time, full packages PA of the cop A and full packages PB of the cop B are stopped on stocking bars 121.1 to 121.4 of the unit group UA and stocking bars 121.5 to 121.6 of the unit group UB, respectively, to assume a temporarily stocked condition (FIG. 6). However, the stocking bars 121.1 to 121.6 are respectively swivelled and operated in accordance with the following schedule, and the full packages PA of the cop A and the full packages PB of the cop B are delivered in a timed relation.

Figure 12:
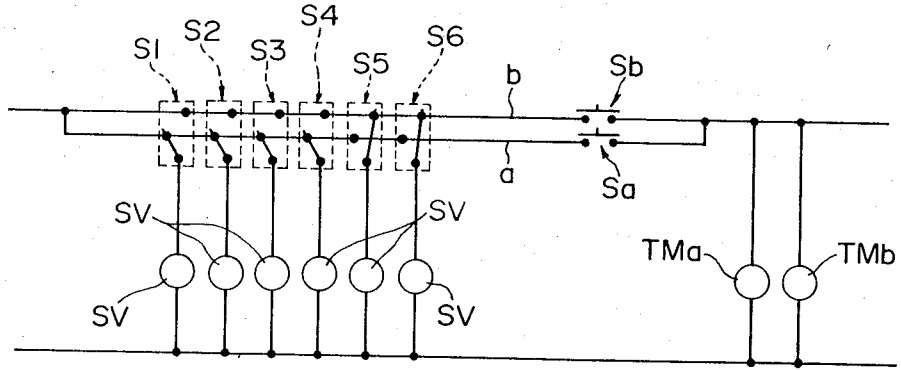
FIG. 12 is a circuitry view showing an example of a working circuit for a fluid cylinder.

That is, a solenoid valve SV of a fluid cylinder 127 of each of the stocking bars 121.1 to 121.6 is connected to a circuit shown in FIG. 12, and can be connected to either parallel circuit a or b so as to be connected to a power source by changing over snap switches S1–S6. In the illustrated embodiment, solenoid valves SV corresponding to the stocking bars 121.1 to 121.4 are connected to the circuit a, and solenoid valves SV corresponding to the stocking bars 121.5 and 121.6 connected to the circuit b. Switches S*a* and S*b* to be turned ON and OFF by timers TMa and TMb, respectively, at given intervals are interposed in said parallel circuits a and b. The timers TMa and TMb are set to time t which is less by about 20% than average winding time T by the automatic winder and are set so as to be actuated with the time-up timing among timers TMa and TMb deviated through deviation dt (for example, five minutes).

Figure 13:
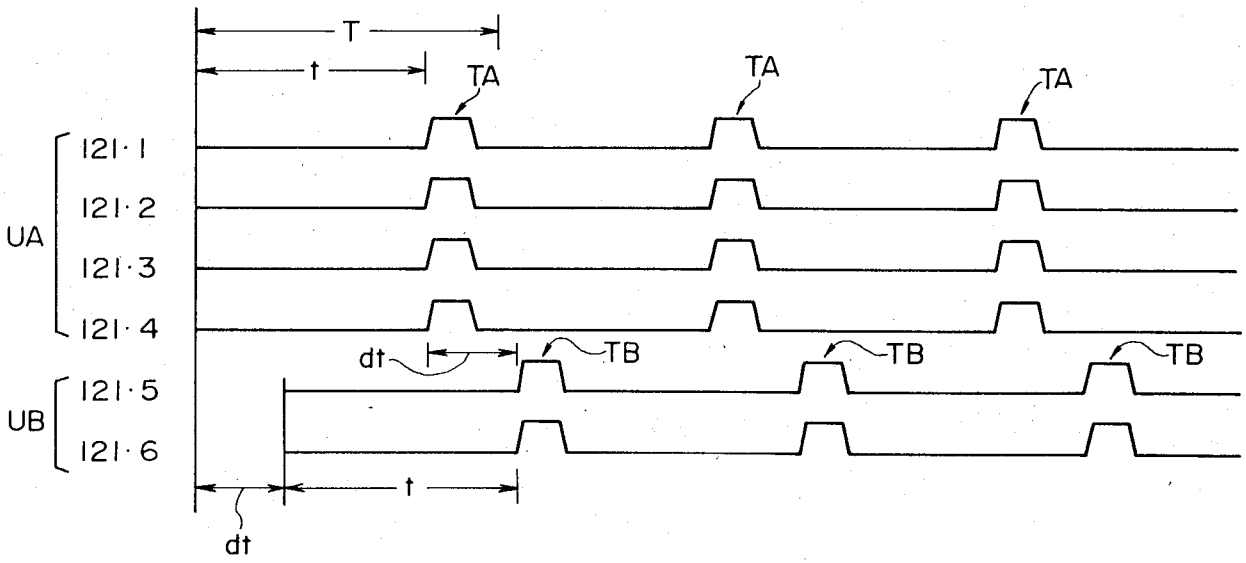
FIG. 13 is a time chart showing working timings of the stocking devices.

Thus, assuming now that for example, the average winding time T set to 60 minutes, the opening interval t of the stocking bar 121 to 50 minutes and the deviation dt to 5 minutes, the stocking bars 121.1 to 121.6 are opened in that order shown in a time chart of FIG. 13, whereby the full packages PA of the cop A of the unit group UA which have been stopped by the stocking bars 121.1 to 121.4 are released at once by the swivelling motion of the stocking bars 121.1 to 121.4 at the time TA and immediately (at least within five minutes, the dt from the time TA) the full packages PB of the cop B of the unit group UB which have been stopped by the stocking bars 121.5 and 121.6 are released simultaneouly by the swivelling motion of the stocking bars 121.5 and 121.6 at the time TB and immediately delivered by the coneyor 114. The time-up deviation dt between the timers TMa and TMb is variously set in accordance with the delivery speed of a conveyor 114.

In accordance with the time chart of FIG. 13, the first swivelling time TA of the stocking bars 121.1 to 121.4 is prior to the lapse of the average winding time T, and it is therefore expected that only a minority of full packages wound early are delivered, but from the swivelling time TA after the second swivelling, full packages PA in quantity of about 40 on the average are delivered simutaneously, and at the swivelling TB of the stocking bars 121.5 and 121.6, full packages PB in quantity of about 20 on the average are delivered simultaneously every time.

The thus delivered full packages PA and PB are lifted one by one by means of a lifter 130 provided on the end of the conveyor 114 schematically shown in FIG. 11 to externally engage an overhead conveyor 132 having a hook 131 which travels overhead. Alternatively, an end feeler (not shown) is provided on the end of the conveyor 114, and an operator is informed of a delivery of the full package PA or PB to the end of the conveyor 114. A warning device such as a lamp, an alarm or the like may be connected to said end feeder so that the operator who receives such warning may receive the packages PA or PB into containers which are different in kind of yarns at the outlet position of the conveyor 114. Anyhow, the full packages PA and PB different in kind of threads which have been stopped by the stocking device 120 are delivered in a timed relation and are, if they are of the same kind, delivered at one time. Therefore, the packages of different kinds are not mixed at random and the sorting work previously performed later may be omitted.

In the above-described embodiment, the stocking devices 120 are independently provided for each group of 10 spindles, and working timing of each of the stocking bars 121.1 to 121.6 can be simply switched to the case which uses the timer TMa and to the case which uses the time TMb merely by changing over the snap switches S1–S6. Therefore, even in the case where the number of lots of cops is desired to be changed to change a proportion of the unit groups UA and UB, that is, even in the case where for example, the 1st–30th spindle are desired to be a new unit group UA and the 31st–60th spindle to be a new group UB, packages which have been stopped by the stocking bar 121.4 are newly ejected at timing TB by merely switching the snap switch S4, thus readily coping with the change in the unit group.

In the case where more than three kinds of different cops are wound, that is, in the case where for example, the 1st–20th spindle are provided for the unit group to wind the cop A, the 21st–50th spindle provided for the unit group to wind the cop B, and the 51st–60th weight provided for the unit group to wind the cop C, said power source circuits a and b are further branched to form three parallel circuits whereby connection of solenoid valves SV corresponding to the fluid cylinders 127 for actuating the stocking bars to said three power source circuits is made such that the snap switches S1, S2 and S3 are connected to the circuit a, the snap switches S4 and S5 to the circuits b and the snap switch S6 to the newly branched circuit so that the stocking device 120 corresponding to each of the unit groups may be swivelled in accordance with the working timing created by the different timers.

Anyhow, as described above, in accordance with the doffing system of the present embodiment, there is provided an arrangement wherein in an automatic winder having a number of winding units juxtaposed thereon, a stocking device for temporaily stopping full packages is provided midway along a package guide passage disposed between a conveying conveyor which extends along said units and travels with the full packages placed thereon, and a position wherein the full package is disengaged from a cradle portion of each of the winding units, said stocking device being operable independently for every group of units of said automatic winder divided into more than two. Therefore, the packages which are doffed and temporarily stopped by said stocking devices can be separately released for every unit group and the packages wound by the unit groups can be delivered without being mixed.

I claim:

1. A doffing apparatus in an automatic winder having a plurality of package winding units arranged in a row, said winder including a transporting conveyor extending along the package winding units for conveying doffed full packages from the package winding units, said doffing apparatus comprising:

a plurality of package guide paths, disposed to extend from a position of each package winding unit at which full packages are discharged from a cradle portion of the winding unit, respectively, to said transporting conveyor, each of said package guide paths being formed of a bottom plate and a side plate such that each is sufficiently inclined downwardly toward said transporting conveyor to enable a doffed full package to roll along its package guide path under gravity;

a stocking device, pivotably disposed from a frame of said automatic winder so as to be capable of pivoting between a first pivotal position and a second pivotal position, said first pivotal position being adpated with respect to each of said plurality of package guide paths so as to be capable of simultaneously stopping full packages substantially midway of the extents of said package guide paths, said said second pivotal position being adapted with respect to each of said plurality of package guide paths so as to simultaneously enable packages to proceed along each of said plurality of package guide paths to said transporting conveyor; and means for periodically pivoting said stocking device, in response to a timing circuit, from said first pivotal position to said second pivotal position, and the reverse.

2. A doffing apparatus as claimed in claim 1, wherein said stocking device comprises:

a stocking bar extending along the plurality of winding units;

a supporting bar extending along the plurality of winding units and rotatably supported on bearings secured to the frame of the automatic winder; and a pluarlity of brackets affixed between said supporting bar and said stocking bar in a suitably spaced relation so as to support said stocking bar in positions parallel with said supporting bar.

3. A doffing apparatus as claimed in claim 2, wherein said supporting bar is so disposed and said brackets are so configured as to support said stocking bar when in said first pivotal position such that a circular locus of the center of the stocking bar, defined by an extension of its arc of rotation between said first and second pivotal positions, passes through the center of a package located at the position along said package guide path at which it is stopped by the stocking bar.

4. In an automatic winder having a plurality of package winding units arranged in a row, said winder including a transporting conveyor extending along the package winding units for conveying doffed full packages from the package winding units, said pluality of package winding units being segregated into a plurality of groups of package winding units, each group being adapted to wind a particular type of package, with the type of package differing from group to group, a doffing apparatus comprising:

a plurality of package guide passages, disposed to extend from a position of each package winding unit at which full packages of either type are discharged from a cradle position of the winding unit, respectively, to said transporting conveyor, each of said package guide passages being formed of a bottom plate and at least one side plate such that each is sufficiently inclined downwardly toward said transporting conveyor to enable a doffed full package to roll along its package guide passage under the influence of gravity;

a plurality of stocking devices, in like number as said groups of winding units, each pivotably disposed from a frame of said automatic winder so as to be capable of pivoting between a first pivotal position and a second pivotal position, said first pivotal position being adapted with respect to each of the package guide passages of the group of winding units associated with said stocking device so as to be capable of stopping full packages substantially midway of the extents of said package guide passages, and said second pivotal position being adapted with respect to each of the package guide passages of the group of winding units associated with said stocking device so as to enable full packages to simultaneously proceed along each of said package guide passages to said transporting conveyor; and means for independently periodically pivoting said plurality of stocking devices, in response to a timing circuit, from said first pivotal positions to said second pivotal positions, and the reverse, said timing circuit providing that only those stocking devices controlling a particular type of full package are pivoted to the second pivotal position at any given time.

5. A doffing apparatus as claimed in claim 4, wherein each of said stocking devices comprises:

a supporting bar extending along the plurality of winding units forming the group of winding units, said supporting bar being rotatably supported on bearings secured to the frame of the automatic winder;

a stocking bar extending along the plurality of winding units forming the group of winding units so as to be disposed substantially parallel to and coextensive with said supporting bar; and a plurality of brackets, disposed in a suitably spaced apart relation, affixed between said supporting bar and said stocking bar so as to support said stocking bar in said first and said second pivotal positions.

6. A doffing apparatus and claimed in claim 5, wherein said supporting bars are so disposed and said brackets are so configured as to support said stocking bars, when in their respective first pivotal positions, such that a circular locus of the center of each of the stocking bars, defined by an extension of its arc of rotation between its first and its second pivotal position, passes through the center of a full package of the type which is stopped by each stocking bar.

* * * * *